US005386358A

United States Patent [19]

Hillinger

[11] Patent Number: 5,386,358

[45] Date of Patent: Jan. 31, 1995

[54] PORTABLE, TWIN-MOUNTED LIGHT ASSEMBLY

[75] Inventor: George Hillinger, Beverly Hills, Calif.

[73] Assignee: Alltrade, Inc., Long Beach, Calif.

[21] Appl. No.: 254,124

[22] Filed: Jun. 6, 1994

[51] Int. Cl.[6] ..... F21V 21/00

[52] U.S. Cl. ..... 362/431; 362/426; 362/376; 248/122; 248/187; 248/222.1; 248/274

[58] Field of Search ..... 362/431, 376, 410, 411, 362/426, 382, 432, 427; 248/121, 122, 906, 187, 178, 176, 222.1, 274

[56] References Cited

U.S. PATENT DOCUMENTS

| | | | |
|---|---|---|---|
| 2,652,220 | 9/1953 | Nocht | 248/187 |
| 4,428,037 | 1/1984 | Cardoza et al. | 362/431 |
| 4,894,759 | 1/1990 | Siems | 362/431 |
| 5,060,894 | 10/1991 | Hillinger | 248/170 |
| 5,088,014 | 2/1992 | Boughey | 362/132 |
| 5,126,928 | 6/1992 | Hughes | 362/287 |
| 5,195,823 | 3/1993 | Sidabras | 362/376 |
| 5,205,645 | 4/1993 | Lee | 362/431 |
| 5,213,413 | 5/1993 | Weathers | 362/431 |
| 5,243,507 | 9/1993 | Atkins et al. | 362/376 |
| 5,306,871 | 4/1994 | Lai | 362/431 |

*Primary Examiner*—Ira S. Lazarus
*Assistant Examiner*—Sara Sachie Raab
*Attorney, Agent, or Firm*—Albert O. Cota

[57] ABSTRACT

A portable, twin-mounted light assembly (10) having a stand assembly (12) supported by a stable platform (14) and having on its top edge (120), a mounting bracket (16). The bracket (16) is disclosed in three designs: an inverted L-bracket (18), a double U-channel bracket (20) and a channeled L-bracket (24). In all designs, the bracket supports a primary-power junction box (26) and a detachable light-fixture attachment T-section (28). To each end of the T-section (28) is removably attached a light fixture assembly (34). The assembly includes a pair of legs (42,44) that when compressed fit into the end of the T-section (28). Conversely, when they are removed from the T-section (28), the two legs extend outwardly to allow the light fixture assembly (34) to be placed on a flat surface remote form the assembly (10). In a preferred embodiment, the two legs (42,44) have inserted a leaf spring (46) that automatically places the two legs in their extended position when the legs are removed from the light-fixture attachment T-section (28).

20 Claims, 6 Drawing Sheets

PORTABLE, TWIN-MOUNTED LIGHT ASSEMBLY

TECHNICAL FIELD

The invention pertains to the general field of twin-mounted light assemblies and more particularly to a light assembly having dual light fixtures that can be operated while attached to the assembly or that can be easily detached and used at a remote location from the light assembly.

BACKGROUND ART

The utility provided by portable, light fixtures that are located on each end of a secured, articulated T-section is well established. This type of light assembly finds utility in automotive repair shops, photography studios, construction and as general lighting assemblies that are placed in selected locations to illuminate various objects and areas.

In the prior art, the portable, twin-mounted light assemblies generally include structure to secure the light fixture in selectable horizontal and vertical angular positions. The T-section is typically supported by a vertical telescopic stand that has on its lower end a stable platform such as a tripod design or a weighted stand. The light assemblies currently available and disclosed in the prior art are either equipped with one light fixture that is attached to one end of a light-fixture attachment T-section; or, if a twin light is used, there is a light fixture located on each end of a T-section. These light fixtures are attached to the T-section in such a manner that their removal from the T-section is not functionally feasible.

The instant invention differs from the prior art light assemblies in the structural design of the light-fixture attachment T-section and most significantly, in the design of the light fixtures. These light fixture are designed to be easily attached and detached from the light-fixture T-section. When detached, they become portable and can be operated at a distance from the primary structure of the light assembly.

A search of the prior art did not disclose any patents that read directly on the claims of the instant invention, however the following U.S. patents are considered related:

| U.S. PAT. NO. | INVENTOR | ISSUED |
|---|---|---|
| 5,126,928 | Hughes | 30 June 1994 |
| 5,088,014 | Boughey | 11 February 1994 |
| 5,060,894 | Hillinger | 29 October 1991 |

The U.S. Pat. No. 5,126,928 Hughes patent discloses a mobile boom-mounted light fixture that is particularly adapted for use in connection with the maintenance and repair of motor vehicles. The single boom light is provided with four separate degrees of freedom and the boom assembly allows the light fixture to be rotated transversely about the upward longitudinal axis of the stand; to be rotated vertically; to be rotated about the axis of the boom assembly; and to be pivoted from its position on the end of the boom assembly. Once a position is selected, the position is fixed by a brake and friction plate mechanism.

The U.S. Pat. No. 5,088,014 Boughey patent discloses a tool caddy having an upward projecting boom that includes at its upward end a light fixture. The boom is movable on a lower supporting surface and includes a central support member having trays for storing tools. The lower section of the supporting surface includes a set of caster wheels that allows mobility. The T-section also includes an extension member and an adjustable strut. The strut allows the position of the boom to be fixed with respect to the extension member.

The U.S. Pat. No. 5,060,894 Hillinger patent discloses a collapsible three leg structure that is used to support a stand with a T-section having at least one light fixture attached to its end. The collapsible legs are held to the stand by a disk member held within a pair of ears. One of the ears has a toothed opening as does the disk member. A gear member may be moved to a locked position where the gear contacts the toothed portions of the disk member and one of the ears which locks the disk in a fixed position. When the gear is moved out of contact with the disk member, the disk member is free to move with respect to the pair of ears. Thus, allowing the legs to be placed in various locked positions. Note that the inventor of this patent is also the inventor of the instant application which utilizes the collapsible legs portion of the patent.

DISCLOSURE OF THE INVENTION

The portable twin-mounted light assembly is designed to provide a convenient practical method of illuminating various objects and areas with a pair of elevated light fixture assemblies. In its basic form, the assembly consists of:

a) a stand assembly that includes a vertical rod having an upper section that includes a top edge and a lower section to which is attached a stable platform. The platform preferably consists of a tripod as disclosed in U.S. Pat. No. 5,060,894 issued to the applicant and incorporated herein by reference. The assembly in the preferred embodiment also employs a telescoping vertical rod that allows the assembly to be placed and locked at selectable heights, b) a light-fixture attachment T-section comprised of an elongated hollow tube having a first end, a second end, and having means for being attached to the top edge of the stand assembly, c) a pair of light fixture assemblies with each assembly consisting of:

(1) a lamp housing having a bottom side and means for receiving a source of electrical power that powers a lamp attached and enclosed within the lamp housing, (2) a horizontal mounting structure attached by an attachment means to the bottom side of the lamp housing. The horizontal mounting structure has a front segment consisting of a downward extending channel having a front channel section and a back channel section. Each section respectively has a front swivel bore and a back swivel bore in alignment and spaced apart in a horizontal plane, d) a first light-fixture leg having a vertical section with an upper end and a lower end. From the lower end contiguously extends a horizontal section. The vertical section further has near its upper end a swivel bore. The first light fixture leg is inserted into the channel of the horizontal mounting structure with the first swivel bore interfacing with the respective first and second swivel bores on the horizontal structure. When a first swivel pin is inserted through the three bores, the first light fixture leg is free to pivot about the first swivel pin, e) a second light-fixture leg having a vertical section with an upper end and a lower end, from where the lower end contiguously extends a horizontal section. The vertical section also includes near its upper end a swivel bore. The second light fixture leg is inserted into the channel of the horizontal mounting structure with the second swivel bore interfacing with the respective first and second swivel bores on the horizontal structure. When a second swivel pin is inserted through the three bores, the second light fixture leg is free to pivot about the second swivel pin. When the first and second light fixture legs are pressed together they are sized to be frictionally inserted into either the first or second end of the light-fixture attachment T-section and securely attached within the T-section by an attachment means, and f) means for maintaining the first and second light fixture legs in an open, extended position to allow the light fixture assembly, when removed from said T-section, to be placed upon a surface remote from said portable twin-mounted light assembly. The preferred means for maintaining the legs in the open, extended position comprises a leaf spring. The spring has a first end, a second end, and is dimensioned to be placed over or under the first and second swivel pins. The first end of the spring is inserted into the first light-fixture leg and the second end is inserted into the second light-fixture leg. When inserted, the force of the leaf spring forces the first and second light fixture legs to extend outwardly until stopped when the upper end of the legs abut with the horizontal mounting structure. Thus, allowing the two legs to be maintained in an optimum, extended position.

In view of the above disclosure, it is the primary object of the invention to provide a portable twin-mounted light assembly that incorporates a pair of positionable light fixture assemblies that are attached to each end of a light fixture attachment T-section. The invention features the option of operating the light fixture assemblies while attached to the T-section, or to remove either or both of the light assemblies and placing and operating them from a location remote from the structure of the light assembly.

In addition to the above primary object, it is also an object of the invention to produce a light assembly that:

can be dismantled for storage or shipping, includes a light assembly that is positionable in height and in various vertical and horizontal positions, provides an efficient light distribution, can be plugged into any standard 120-volt a-c outlet, can be manufactured from a variety of metals and plastics, is rugged in construction, is reliable and virtually maintenance free with the exception of replacing lamps, and is cost effective from both a manufacturer's and consumer's points of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
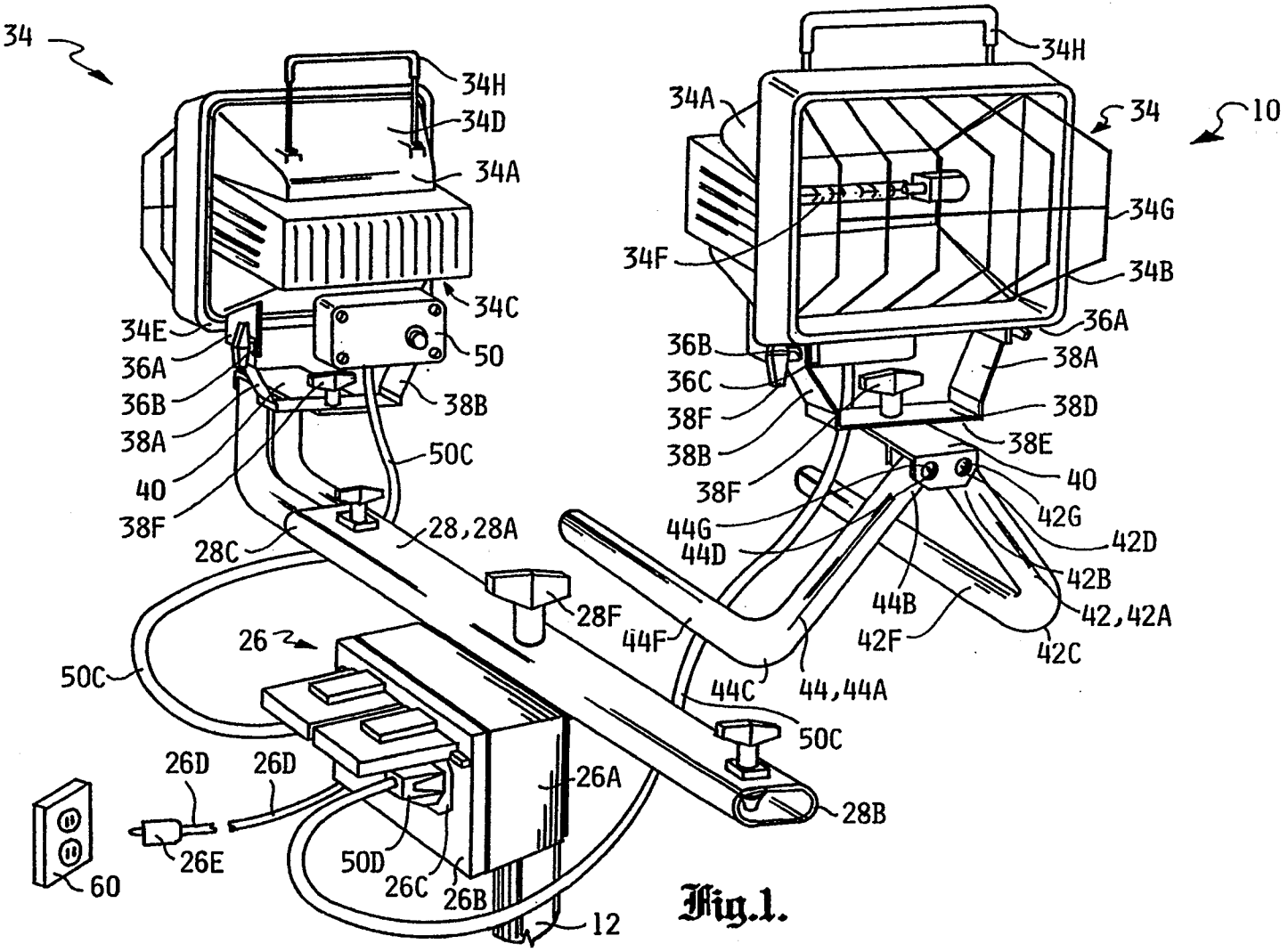
FIG. 1 is a perspective view of the portable, twin-mounted light assembly showing one of the light assemblies inserted into the light-fixture attachment T-section and the second light assembly removed from the T-section.

The best mode for carrying out the portable, twin-mounted light assembly 10 is shown in FIGS. 1–13 and is comprised of the following major elements: a stand assembly 12, a stable platform 14, a bracket 16 disclosed as an inverted L-bracket 18, a double U-channel bracket 20 and a channeled L-bracket 24, a primary power junction box 26, a light-fixture attachment T-section 28, an L-bracket 30, a light fixture assembly 34, a light-fixture attachment means 36, a U-shaped housing mounting bracket 38, a horizontal mounting structure 40, a first light fixture leg 42, a second light fixture leg 44, a leaf spring 46, a horizontal split latch 48 and a lamp-power junction box 50.

Figure 2:
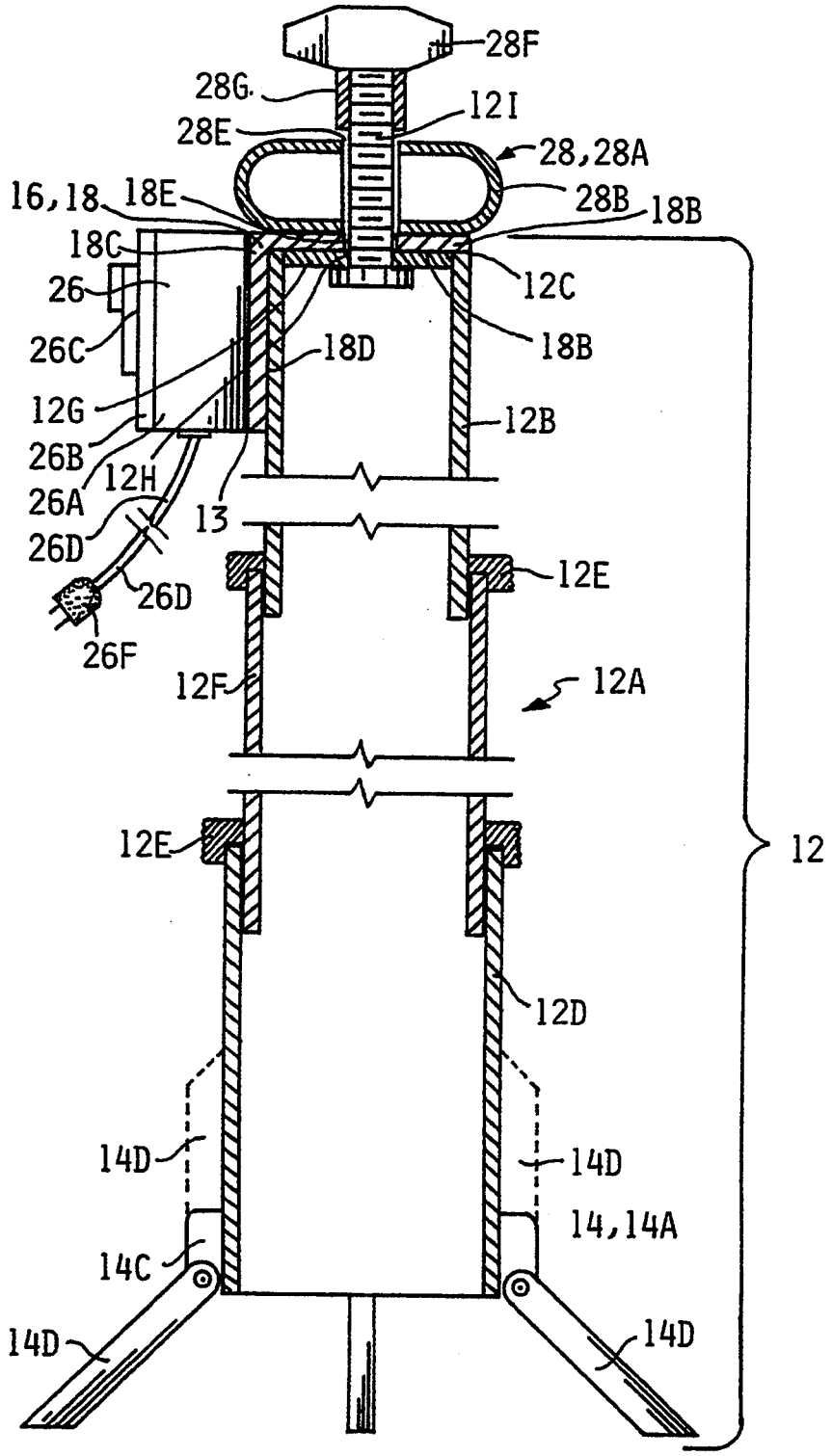
FIG. 2 is an elevational-sectional side view of an inverted L-bracket that attaches to the stand assembly and that supports the light-fixture attachment T-section and the primary-power junction box.
Figures 3, 4, 5, 6:
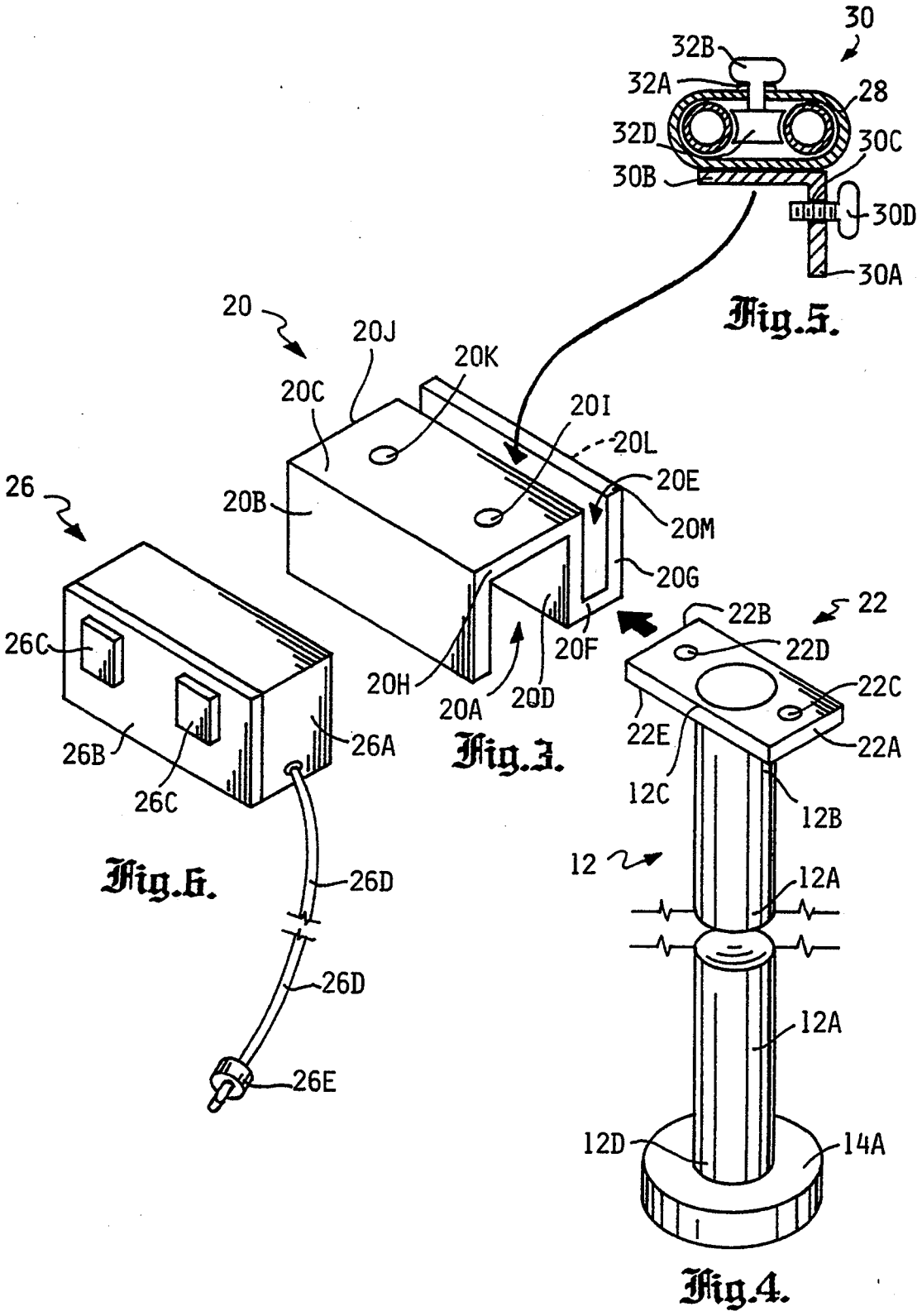
FIG. 3 is a perspective view of a double U-channel bracket.
FIG. 4 is a perspective view of an attachment plate that is attached to the stand assembly and to a plate channel located on the double U-channel bracket shown in FIG. 3.
FIG. 5 is an elevational side view of a light-bracket attachment T-section attached to an inverted L-bracket that attaches to a bracket channel located on the double U-channel bracket shown in FIG. 3.
FIG. 6 is a perspective view of the primary-power junction box that attaches to a first vertical section located on the double U-channel bracket shown in FIG. 3.

The stand assembly 12 as shown in FIGS. 1 and 2, is comprised of a vertical rod 12A having an upper section 12B that includes a top edge 12C, and a lower section 12D. To the lower section is attached by an attachment means, a stable platform 14. The platform may consist of a weighted stand 14A as shown in FIG. 4 or preferably of a tripod assembly 14B as shown in FIG. 1. The tripod assembly has locking means 14C for locking the tripod legs in an extended stable platform position as shown in FIG. 2 or in raised (stowed) position against the surface of the lower section 12D of the vertical rod 12A as shown by the phantom lines also in FIG. 2. The tripod assembly is disclosed in detail in the applicant's U.S. Pat. No. 5,060,894 which is included herein by reference.

The vertical rod 12A may be further comprised of an upper section 12B and at least one tubular lower section 12D. Preferably, as shown in FIG. 2, the upper section 12B is sized to slidably be inserted into a middle section 12F which in turn, is slidably inserted into the lower section 12D. At each section junction, there is located a locking ring 12E that allows the respective section to be placed and locked at selectable telescoping heights.

The assembly 10 utilizes the bracket 16 to attach the primary-power junction box 26 and the light-fixture attachment T-section 28.

Figure 7:
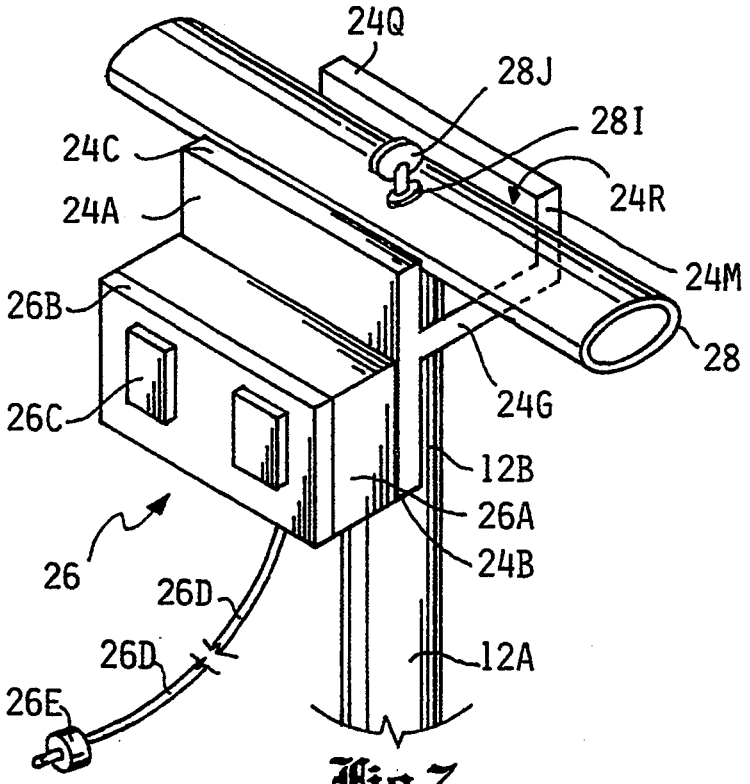
FIG. 7 is a perspective view of a channeled L-bracket having a T-section channel that receives the light-fixture attachment T-section and a front vertical section that attaches to the primary-power junction box.
Figure 8:
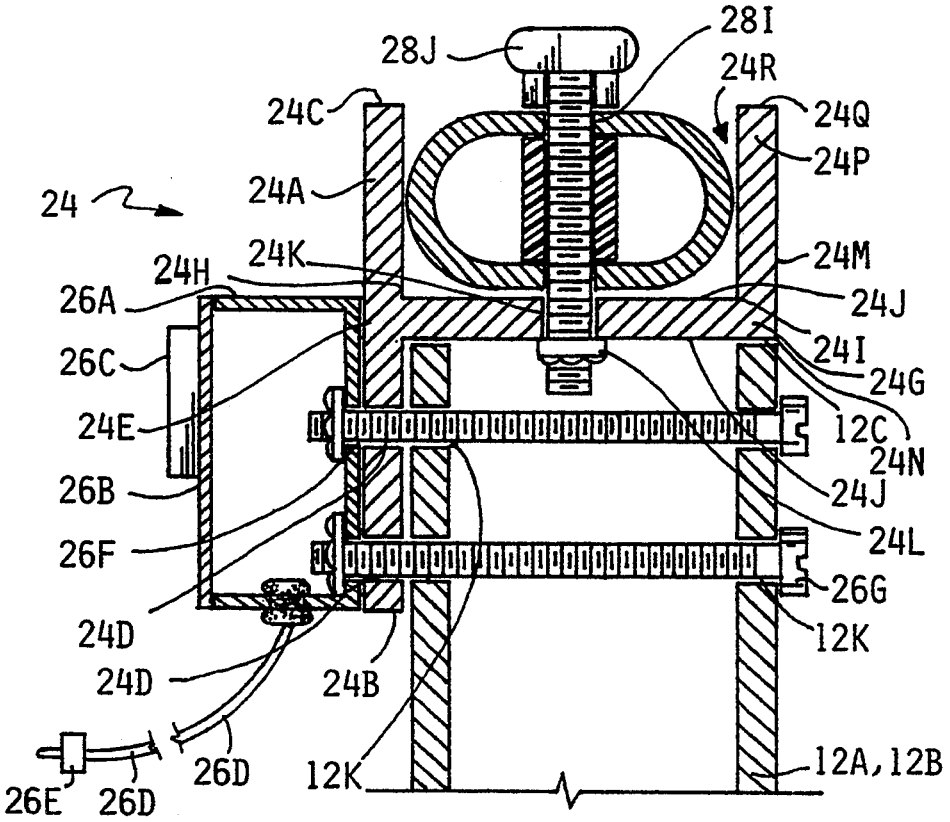
FIG. 8 is an elevational side view of the channeled L-bracket as shown in FIG. 7.

The primary-power junction box 26 as best shown in FIG. 1, consists of an enclosed box that includes a back section 26A and a front section 26B. In all the bracket designs, the back section 26A is attached to the front vertical section of the respective bracket 16 by an attachment means. This attachment means may consist of a welding technique as might be used as shown in FIGS. 2 and 6, or a combination bolt and nut combination as shown in FIGS. 7 and 8. The front section 26B includes a pair of moisture-proof a-c female receptacles 26C. The receptacles are connected to a primary a-c power cord 26D that terminates with an a-c male connector 26E that plugs into an a-c utility power outlet 60 as also best shown in FIG. 1.

The bracket 16 includes a means for being attached to the top edge 12C of the upper section 12B of the vertical rod 12A and is disclosed in three designs; an inserted L-bracket 18, a double U-channel bracket 20 and a channeled L-bracket 24.

The inverted L-bracket 18 and the means for attaching the bracket to the top edge 12C of the vertical rod 12A is shown in FIG. 2. To utilize the inverted L-bracket a hollow upper section 12B is used. Into the top edge 12C of this hollow upper section is inserted and attached by an attachment means, a rod cap 12G having a substantially centered bolt bore 12H therethrough. Into the bolt bore is inserted and rigidly attached a threaded bolt 12I with the bolt's threaded section extending upward as shown in FIG. 2.

The inverted L-bracket 18 has a horizontal section 18A having a lower surface 18B and a downward extending front vertical section 18C having an inward surface 18D. The horizontal section 18A includes a bore 18E therethrough that is inserted over the threaded section of the bolt 12I. When so inserted, the bracket's lower surface 18B is attached to the top edge 12C of the vertical rod 12A and the rod cap 12G by an attachment means that includes an adhesive or spot welding. When so attached, the inward surface 18D of the vertical section 18C rests against the surface of the upper section 12B of the vertical rod 12A as shown in FIG. 2.

The light-fixture attachment T-section 28 in its general configuration is comprised of an elongated hollow tube 28A having a first end 28B, a second end 28C and a means for being removably attached to the horizontal side of one of brackets.

The T-section 28 used with the inverted L-bracket 18 as shown in FIGS. 1 and 3, has a substantially centered attachment bore 28E therethrough that is inserted over the upward extending threaded bolt 12I as shown in FIG. 2. To the upper section of the threaded bolt 12I is located a threaded wing nut 28F having a lower threaded section 28G that is sized to be received by the threaded bolt 12I. When the handle 28F is loosened, the light fixture attachment T-section 28 can be placed in any selectable, horizontal angular position. When the position is selected, the handle 28F is rotated until the T-section 28 is tightened against the top edge 12C of the vertical rod 12A. To remove the T-section for transportation or repair, the threaded handle is removed and the T-section is raised over the threaded bolt 12I.

The second bracket design is the double U-channel bracket 20 which includes the means for attaching the bracket to the top edge 12C of the vertical rod 12A. The bracket 20 as shown in FIG. 3, consists of an upper extending plate channel 20A that is comprised of a contiguous front vertical section 20B, an upper horizontal section 20C and a back vertical section 20D. Adjacent the plate channel 20A is a contiguous, lower-extending bracket channel 20E that is comprised of the back vertical section 20D, a lower horizontal section 20F and a rear vertical section 20G. The upper horizontal 20C further includes near a first side edge 20H, a first bore 20I and near a second side edge 20J, a second bore 20K. The rear vertical section 20G includes a substantially centered and threaded bore 20L therethrough, and a top edge terminus 20M that is substantially on the same horizontal plane as the upper horizontal section 20C.

The double U-channel bracket 20 is used in combination with an attachment plate 22. This plate as shown in FIG. 4, has a first side edge 22A, a second side edge 22B. Near these first and second side edges is located respectively a first bore 22C and a second bore 22D. The plate 22 has a bottom surface 22E that is attached to the top edge 12C of the upper section 12B of the vertical rod 12A by an attachment means. When the plate 22 is inserted into the plate channel 20A and a bolt and nut combination (not shown) is inserted into the aligned first and second bores 20I,22C and 20I,22D, on the respective upper horizontal section 20C and the attachment plate 22, the vertical rod 12A is securely fastened to the double U-channel bracket 20.

The means for removably attaching the light-fixture attachment T-section 28 to the double U-channel bracket 20 is accomplished by using an L-bracket 30 as shown in FIG. 5. This bracket has a vertical section 30A, a horizontal section 30B and a width substantially equal to the width of the bracket 30. The vertical section has a threaded bore 30C therethrough that is substantially centered and in alignment with the threaded bore 20L on the rear vertical section 20G of the double U-channel bracket 20. The horizontal section 30B is attached by an attachment means, such as spot welding, to the lower surface of the T-section 28 as shown in FIG. 5. The vertical section 30C of the L-bracket 30 is inserted into the bracket channel on the double U-channel bracket 20 and a wing bolt 30D is threaded through the threaded bores 20L,30C. When the wing bolt 30C is tightened, the light-fixture attachment T-section 28 is secured to the vertical rod 12A.

The channeled L-bracket 24, which is the final bracket design disclosed, and the means for attaching the bracket to the top edge 12C of the vertical rod 12A is shown in FIGS. 7 and 8. The bracket 24 is used with a vertical rod 12A that has through its upper section 12B near its top edge 12C a set of vertically aligned bores 12K. The bracket is comprised of a front vertical section 24A, a horizontal section 24G and a back vertical section 24M. The front vertical section 24A has a bottom edge 24B, a top edge 24C and a set of vertically aligned bores 24D. The bores are located between the bottom edge 24B and near its center 24E and are in alignment with the set of bores 12K located through the vertical rod 12A. The horizontal section 24G has a first edge 24H, a second edge 24I and a bottom surface 24J. The first edge 24H contiguously extends outward from near the center 24E of the front vertical section 24A and has a substantially centered T-section bore 24K therethrough. Captively attached to the bottom surface 24J, in alignment with the T-section bore 24K, is a threaded nut 24L. The back vertical section 24M has a bottom edge 24N and a top edge 24P having a terminus 24Q. The bottom edge 24N is contiguous with the second edge 24I of the horizontal section 24G; and the top edge terminus 24Q is on the same horizontal plane as the top edge 24C of the front vertical section 24A. The horizontal section 24G in combination with the front and back vertical sections 24A,24M forms a T-section channel 24R.

The primary-power junction box 26 used with the bracket 24 further includes, as shown in FIG. 8, a set of vertically aligned bores 26F. These bores are located on its back section 26A in alignment with the set of bores 24D on the front vertical section 24A of the bracket 24 and with the bores 12K on the vertical section 12A. Through this bore set, is inserted a set of bolt and nut combinations 26G. When the nuts are tightened, the primary-power junction box 26 and the channeled L-bracket 24 are secured to the vertical rod 12A.

The means for removably attaching the light-fixture attachment T-section 28 to the channeled L-bracket is accomplished by boring a substantially centered bolt bore 28I through the T-section 28 as best shown in FIG. 8. The T-section is then inserted into the T-section channel 24R and then, a wing bolt 28J is inserted through the T-section bore 28I and into the captive threaded nut 24L. When the wing bolt 28J is tightened, the light-fixture attachment T-section is secured to the vertical rod 12A.

The portable, twin-mounted light assembly 10 is designed to operate with a pair of light fixture assemblies 34 as shown in FIG. 1. Each light assembly is provided with a means for being detachably attached to a respective end of the light fixture attachment T-section 28 and includes a lamp housing 34A, having a front side 34B, a back side 34C, an upper side 34D and a lower side 34E. To the front side 34B is located a protective lamp cage 34G that is attached by an attachment means and to the upper side 34D is attached a handle 34H by an attachment means. To the housing's back side 34C is attached a lamp-power junction box 50 which includes a switch-/circuit breaker 50A. The breaker is preferably equipped with a water-proof jacket 50B which encompasses a switch lever that projects through the front of the lamp-power junction box 50. The switch/circuit breaker 50A is connected in series between the lamp 34F and an a-c power cord 50C that extends from the junction box 50. The cord 50C has a male plug 50D that is inserted into one of the a-c female receptacles 26C located on the primary-power junction box 26. To operate the light assemblies 34, the primary a-c power cord 26D is connected to an a-c utility power outlet 60 and the a-c power cords 50C from the lamp-power junction boxes 50 are connected to the female receptacle 26C on the primary junction box 26. The switch/circuit breaker 50A from either or both of the lamp-power junction boxes may be placed in the ON position to cause the lamp 34F to illuminate.

Figure 9:
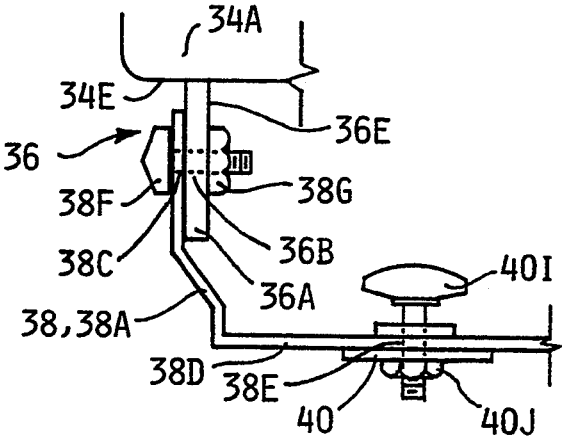
FIG. 9 is an elevational side view showing the attachment configuration of the first mounting flange, the U-shaped housing mounting bracket, and the horizontal mounting structure.

The light fixture assembly 34 includes a light fixture attachment means 36 for allowing the light assemblies to be detachably attached to the respective first end 28B or second end 28C of the light-fixture attachment T-section 28. This attachment means allows the light fixture assemblies 34 to be operated while attached to the T-section 28, or to be removed from the T-section 28 and placed on a remote surface. The attachment means 36, which is identical for either light fixture assembly, consists of a first mounting flange 36A and a second mounting flange 36C. The first mounting flange 36A is attached, as best shown in FIG. 9, to one side of the lower side 34E of the lamp housing 34A and the second mounting flange 36C is attached to the opposite side of the lower side 34E of the lamp housing 34A. Each mounting flange has a mounting bore 36B therethrough having attached to its inside surface 36E, in alignment with the mounting bore 36B, a captive threaded nut 36F.

Attached to the flanges 36A,36C is a U-shaped housing mounting bracket 38 having a first upward section 38A, a second upward section 38B and a contiguous center section 38D. Each upward section 38A,38B has near its edge as shown best in FIG. 9, a vertical adjustment bore 38C, and the center section 38D has a substantially centered horizontal adjustment bore 38E. The two vertical adjustment bores 38C interface with the respective mounting bores 36B on the first and second mounting flange 36A,36C. When a wing bolt 38F is inserted into the two bores and the threaded nut 38G, the lamp housing 34A can be adjusted vertically and tightened by the wing bolt 38F.

Figure 10:
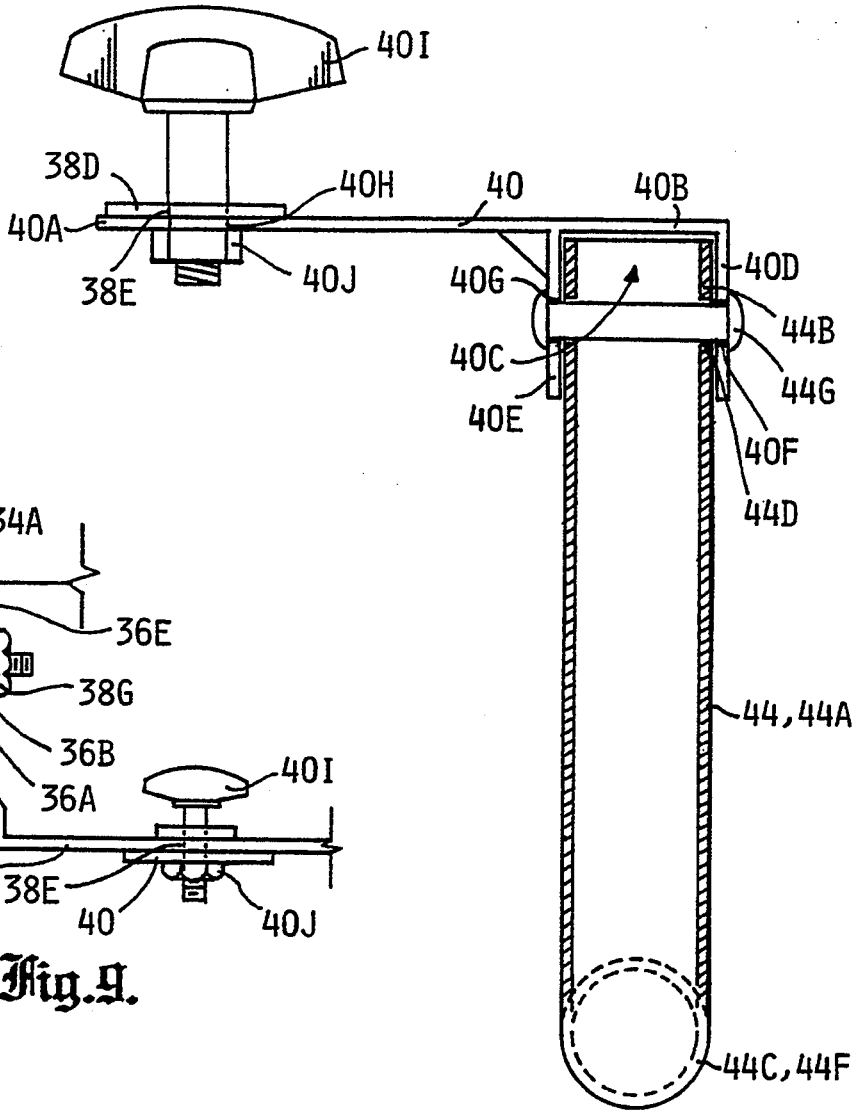
FIG. 10 is an elevational side view showing the attachment configuration of the U-shaped housing mounting bracket, the horizontal mounting bracket, and the second light fixture leg.

To the bottom of the center section 38D is swivelly attached, as shown in FIGS. 1, 9 and 10, a horizontal mounting structure 40. The structure includes a back edge 40A and a front segment 40B consisting of a downward extending channel 40C. The channel has a front channel section 40D and a back channel section 40E. The section 40D has a front swivel bore 40F and the section 40E has a back swivel bore 40G in alignment and spaced apart in a horizontal plane. Near the back edge 40A of the structure 40 is located an attachment bore 40H. When this bore is aligned with the horizontal adjustment bore 38E on the U-shaped housing mounting bracket 38 and a wing bolt 40I is inserted into a nut 40J, as shown in FIGS. 9 and 10, the lamp housing can be rotated and locked in selectable horizontal positions. The horizontal mounting structure 40 functions to attach the first and second light fixture legs 42,44 as shown in FIGS. 10, 11 and 12.

Figure 11:
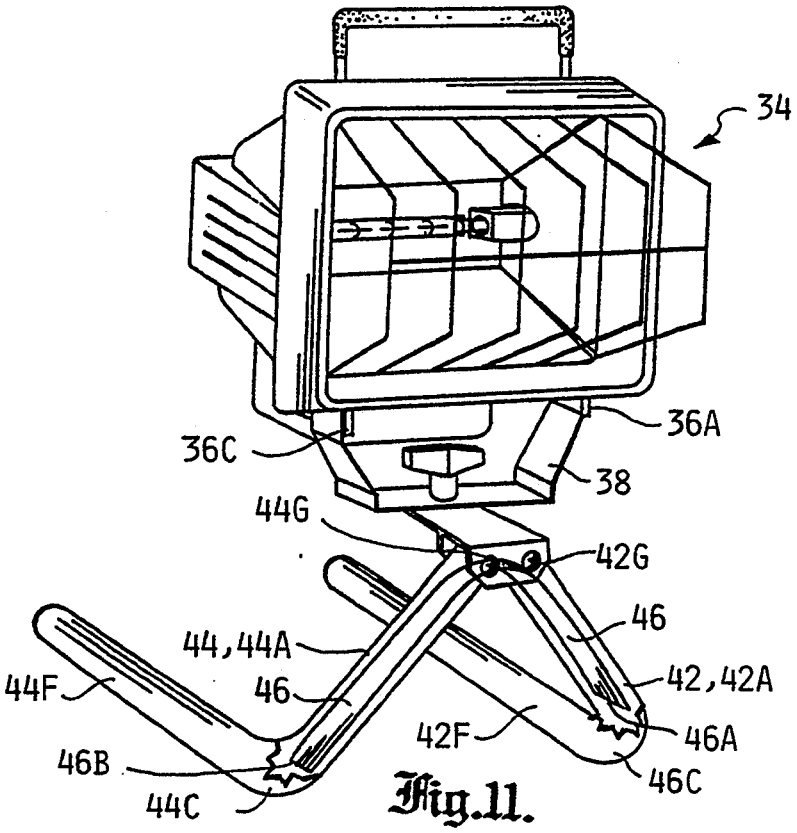
FIG. 11 is a perspective view of a light fixture assembly with a first and second light fixture leg having a leaf spring that maintains the two legs in their extended position.
Figure 12:
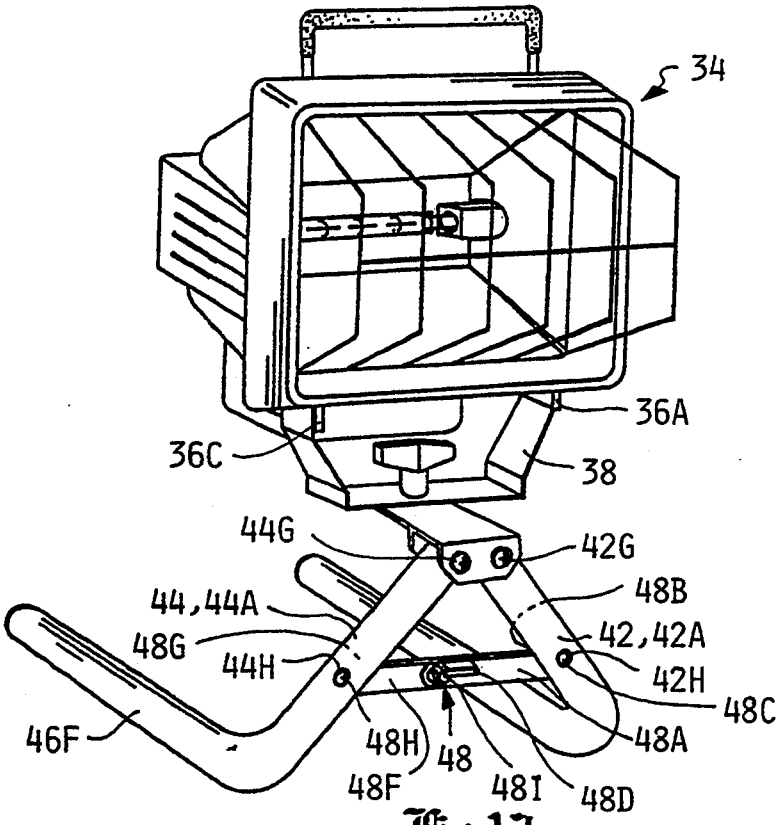
FIG. 12 is a perspective view of a light fixture assembly with a first and second light fixture leg having a horizontal split latch that when attached maintains the two legs in their extended position.

The first light fixture leg 42 as shown in FIGS. 1, 11 and 12, includes a vertical section 42A with an upper end 42B and a lower end 42C. From the lower end 42C contiguously extends inwardly, a horizontal section 42F. The vertical section 42A further has near its upper end 42B a swivel bore 42D. When the first light fixture leg 42 is inserted into the channel 40C of the horizontal mounting structure 40 and the first swivel bore 42D interfaces with the respective first and second swivel bores 40F,40G on the horizontal structure 40, and a first swivel pin 42G is inserted through the three bores, the first light fixture leg 42 is free to pivot about the first swivel pin 42G.

The second light-fixture leg 44 as best shown in FIGS. 1 and 10, includes a vertical section 44A with an upper end 44B and a lower end 44C. From the lower end 44C contiguously extends inwardly, a horizontal section 44F. The vertical section 44A further has near its upper end 44B a swivel bore 44D. When the second light fixture leg 44 is inserted into the channel 40C of the horizontal mounting structure 40 and the second swivel bore 44D interfaces with the respective first and second swivel bores 40F,40G on the horizontal structure 40, and a second swivel pin 44G is inserted through the three bores, the second light fixture leg 44 is free to pivot about the second swivel pin 44G.

The assembly 10, includes means for maintaining the legs 42,44 in an open, extended position to allow the light fixture assembly 34 to be placed upon a surface remote from the portable, twin-mounted light assembly 10. Conversely, when the first and second light fixture legs 42,44 are compressively pressed together they are sized to be frictionally inserted into either the first end 28B or the second end 28C of the light-fixture T-section 28. As shown in FIG. 1, one of the light fixture assemblies 34 is inserted into the T-section 28 and a second light fixture assembly 34 is shown removed from the T-section 28 with the legs 42,44 extended.

Figure 13:
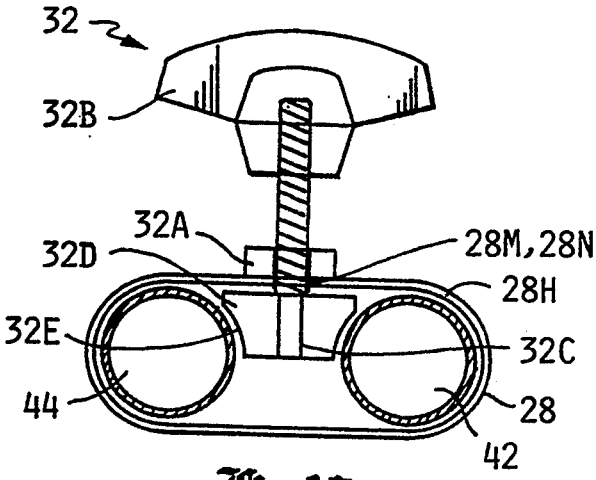
FIG. 13 is an elevational end view showing the first and second light fixture legs inserted into the light-fixture attachment T-section with a leg attachment means for securing the legs to the T-section.

The preferred means 32 utilized for securely attaching the legs 42,44 within the light-fixture attachment T-section 28 is shown in FIG. 13. This means consists of boring a first tightening bore 28M through the upper wall 28H of the T-section 28 near its first end 28B and a second tightening bore 28N near the second end 28C of the T-section 28. Over these bores, is aligned and captively attached a threaded nut 32A. A leg tightening wing bolt 32B is then threaded through each of the nuts 32 and through the respective bores 28M,28N. Each bolt includes a lower end 32P that has attached a clamping structure 32D having an outer contoured surface 32E that corresponds to the curved surface of each leg 42,44. When the wing bolt 32D is tightened, the clamping structure 32D presses against the legs 42,44 to thus secure the legs to the light-fixture attachment T-section 28.

The means for maintaining the legs in their extended position is disclosed in two designs. The first and preferred design requires that the first and second light fixture legs 42,44 be of tubular construction. Into these legs, is inserted a leaf spring 46 as shown in FIG. 11. The spring has a first end 46A, a second end 46B and is dimensioned to be placed over or under the first and second swivel pins 42G,44G. When so placed, the first end 46A is inserted into the vertical section 42A of the first light fixture leg 42, near its lower end; and the second end 46B is inserted into the vertical section 44A of the second light fixture leg 44, near its lower end 44C. When inserted, the force of the leaf spring 46 forces the first and second light fixture legs 42,44 to extend outwardly until stopped when the upper end of the legs abut with the horizontal mounting structure 40. Thus, allowing the two legs to be maintained in an optimum, extended position that allows the light fixture assembly 34 when removed from the T-section 28 to be placed and operated on a flat surface. When it is desired to insert the light fixture into the light-fixture attachment T-section 28, the two legs 42,44 are squeezed together, to overcome the bias of the spring 46, and the leg pair is then inserted into the first or second end 28B,28C of the T-section 28.

The second design as shown in FIG. 12 utilizes a horizontal split latch 48. To attach this latch, the first light fixture leg 42 includes a first leg bore 42H through its vertical section 42A; and a second leg bore 44H through its vertical section 44A. The horizontal split latch consists of a first section 48A having on its inward end, a first side 48D and on its outward end, a first swivel bore 48B. When this bore is aligned with the first leg bore 42H and a first swivel pin 48C is inserted therethrough, the first leg 42 is free to swivel about the pin 48C. The second section 48F of the latch 48 has on its inward end, a second side 48I and on its outward end a second swivel bore 48G. When this bore is aligned with the second leg bore 44H and a second swivel pin 48H is inserted therethrough, the second leg 44 is free to swivel about the pin 48H. When the first and second sections 48A,48F are placed in a horizontal position with the split latch 48 in its locked configuration, the two legs 42,44 are maintained in their extended positions.

While the invention has been described in complete detail and pictorially shown in the accompanying drawings it is not to be limited to such details, since many changes and modifications may be made in the invention without departing from the spirit and scope thereof. Hence, it is described to cover any and all modifications and forms which may come within the language and scope of the appended claims.

I claim:

1. A portable, twin-mounted light assembly comprising:

a) a stand assembly comprised of a vertical rod having an upper section that includes a top edge and a lower section to which is attached, by an attachment means, a stable platform, b) a light-fixture attachment T-section comprised of an elongated hollow tube having a first end, a second end, and means for being attached to the top edge of said stand assembly, c) a pair of light fixture assemblies with each assembly comprising:

(1) a lamp housing having a bottom side and means for receiving a source of electrical power that powers a lamp attached and enclosed within said lamp housing, (2) a horizontal mounting structure attached by an attachment means to the bottom side of said lamp housing, with said horizontal mounting structure having a front segment consisting of a downward extending channel having a front channel section and a back channel section, with each section section, with said front channel section having side-by-side first and second front swivel bores and said back channel section having side-by-side first and second back swivel bores, d) a first light-fixture leg having a vertical section with an upper end and a lower end from where the lower end contiguously extends a horizontal section, with the vertical section further having near its upper end a swivel bore, where when said first light fixture leg is inserted into the channel of said horizontal mounting structure and the first front swivel bore interfaces with the respective first and second swivel bores on said horizontal structure, and a first swivel pin is inserted through the three bores, the first light fixture leg is free to pivot about the first swivel pin, e) a second light-fixture leg having a vertical section with an upper end and a lower end, from where the lower end contiguously extends a horizontal section, with the vertical section further having near its upper end a swivel bore, where when said back light fixture leg is inserted into the channel of said horizontal mounting structure and the second swivel bore interfaces with the respective second front and back swivel bores on said horizontal structure, and a second swivel pin is inserted through the three bores, the second light fixture leg is free to pivot about the second swivel pin, where when said first and second light fixture legs are pressed together they are sized to be frictionally inserted into either the first or second end of said light-fixture attachment T-section and securely attached within the T-section by an attachment means, and f) means for maintaining said first and second light fixture legs in an open, extended position to allow said light fixture assembly, when removed from said T-section, to be placed upon a surface remote from said portable twin-mounted light assembly.

2. The assembly as specified in claim 1 wherein said means for maintaining said legs in an open, extended position comprises a leaf spring having a first end, a second end, and dimensioned to be placed over or under the first and second swivel pins with the first end of the leaf spring inserted into the first light-fixture leg and the second end inserted into the second light-fixture leg, where when inserted, the force of said leaf spring automatically forces the first and second light fixture legs to extend outwardly until stopped when the upper end of the legs abut with the horizontal mounting structure to allow the two legs to be maintained in an optimum, extended position.

3. A portable, twin-mounted light assembly comprising:

a) a stand assembly comprised of a vertical rod having an upper section that includes a top edge and a lower section to which is attached, by an attachment means, a stable platform, b) a bracket having a horizontal section and a downward extending vertical section with said horizontal section having a means for being attached to the top edge of the vertical rod, c) a primary-power junction box having a housing that is attached to the vertical section of said bracket by an attachment means and a front plate that attaches to the housing and having a pair of moisture-proof a-c female receptacles connected to a primary a-c power cord that terminates with an a-c male connector that plugs into an a-c utility power outlet, d) a light-fixture attachment T-section comprised of an elongated hollow tube having a first end, a second end, and means for being removably attached to the horizontal section of said bracket, e) a pair of light fixture assemblies with each assembly comprising:

(1) a lamp housing having a front side, a back side, an upper side and a lower side, (2) a lamp attached and enclosed within said lamp housing, (3) a lamp-power junction box attached to the back side of said lamp housing, with said lamp-power junction box having a switch/circuit breaker connected in series between said lamp and an a-c power cord that extends from the lamp-power junction box and having a male plug that is inserted into one of the a-c female receptacles on said primary-power junction box, and (4) means for being detachably attached to the respective first end or second end of said light-fixture attachment T-section, where said light fixture attachment means allows said light fixture assemblies to be operated while attached to said T-section, or to be removed from said T-section and placed on a remote surface.

4. The assembly as specified in claim 3 wherein said vertical rod is further comprised of an upper section and at least one tubular lower section, where the upper section is sized to slidably be inserted into the lower section, where at the junction of the upper and lower sections is attached a locking ring that allows the upper section to be placed and locked at selectable telescoping heights.

5. The assembly as specified in claim 4 wherein said stable platform is further comprised of a tripod assembly having means for locking the tripod legs in an extended platform position or in a raised position against the surface of the lower section of said vertical rod.

6. The assembly as specified in claim 3 wherein said bracket and said means for attaching said bracket to the top edge of the vertical rod further comprises:

a) said vertical rod being of hollow construction, b) a rod cap having a substantially centered bolt bore therethrough into which is inserted and attached a threaded bolt with the threaded section of the bolt extending upward and where said cap is inserted into the top edge of the hollow vertical rod and attached therein by an attachment means, and c) an inverted L-bracket having a horizontal section with a lower surface, and a downward extending front vertical section with an inward surface, with the horizontal section having a bore therethrough that is inserted over the threaded section of the bolt with the lower surface attached to the top edge of the vertical rod and the rod cap by an attachment means, where when the horizontal section is attached, the inward surface of the vertical section rests against the surface of the upper section of the vertical rod.

7. The assembly as specified in claim 6 wherein said means for removably attaching and positioning said light-fixture attachment T-section to the horizontal section of said inverted L-bracket further comprises:

a) said light-fixture attachment T-section having a substantially centered attachment bore therethrough, where said attachment bore is inserted over the upward extending threaded bolt, and b) a threaded wing nut having a lower threaded section sized to be threaded into an upper section of the threaded bolt, where when the threaded wing nut is loose, said light-fixture attachment T-section can be placed in any selectable, horizontal angular position and secured in place by rotating the threaded handle until said T-section is tightened against the top edge of the vertical rod.

8. The assembly as specified in claim 3 wherein said bracket and said means for attaching said bracket to the top edge of the vertical rod further comprises:

a) a double U-channel bracket comprising:

(1) an upper-extending plate channel comprised of a contiguous front vertical section, an upper horizontal section and a back vertical section, with the upper horizontal section having near a first side edge a first bore and having near a second side edge a second bore, (2) a contiguous lower extending bracket channel comprised of the back vertical section, a lower horizontal section and a rear vertical section having a substantially centered and threaded bore therethrough and a top edge terminus that is substantially on the same horizontal plate as the upper horizontal section, and b) an attachment plate having a first side edge, a second side edge, and having near the first and second edges a first bore and a second bore respectively, where said plate has a bottom surface that is attached to the top edge of the upper section of the vertical rod by an attachment means, where when said plate is inserted into the plate channel and a bolt and nut combination is inserted into the aligned first and second bores on the respective upper horizontal section and the attachment plate, the vertical rod is securely fastened to said double U-channel bracket.

9. The assembly as specified in claim 8 wherein said means for removably attaching said light-fixture attachment T-section to said double U-channel bracket is comprised of an L-bracket having a vertical section, a horizontal section, and a width substantially equal to the width of said double U-channel bracket, with the vertical section having a threaded bore therethrough that is substantially centered and in alignment with the threaded bore on the rear vertical section of said double U-channel bracket, where the upper surface of the horizontal section is attached, by an attachment means, to the lower surface of said light-fixture attachment T-section, where when the vertical section of said L-bracket is inserted into the bracket channel on said double U-channel bracket and a wing bolt is threaded through the threaded bores on said L-bracket and the back vertical section said double U-channel bracket and the wing nut is tightened, said light-fixture attachment T-section is secured to the vertical rod.

10. The assembly as specified in claim 9 wherein said means for attaching said primary junction box to said double U-channel bracket is comprised of a welding technique that allows the housing of said primary junction box to be attached to the front vertical section of said double U-channel bracket.

11. The assembly as specified in claim 3 wherein said bracket and said means for attaching said bracket to the top edge of the vertical rod further comprises:

a) a set of vertically aligned bores located through the upper section of said vertical rod near its top edge, b) a channeled L-bracket comprising:

(1) a front vertical section having a bottom edge, a top edge and a set of vertically aligned bores located between the bottom edge and its center and alignment with the set of bores through said vertical rod, (2) a horizontal section having a first edge, a second edge and a bottom surface, where the first edge contiguously extends outward from near the center of the front vertical section and having a substantially centered T-section bore therethrough that has a threaded nut captively attached to its bottom surface in alignment with the T-section bore, (3) a back vertical section having a bottom edge and a top edge, where the back vertical section bottom edge is contiguous with the second edge of the horizontal section, and the top edge terminus is on a same horizontal plane as the top edge of the front vertical section, where the horizontal section in combination with the front and back vertical sections forms a T-section channel, and c) said primary-power junction box having a set of vertically aligned bores located on its back section in alignment with the set of bores on the front vertical section of said channeled L-bracket and said vertical rod, where when a set of bolt and nut combinations are inserted through said bore sets and tightened, said primary-power junction box and said channeled L-bracket are secured to the vertical rod.

12. The assembly as specified in claim 11 wherein further comprising a light-fixture attachment T-section having a substantially centered bolt bore therethrough, where when said T-section is inserted into the T-section channel of said channeled L-bracket and a wing bolt is inserted through the T-section bore, threaded into the threaded nut tightened, said light-fixture attachment T-section is secured to the vertical rod.

13. The assembly as specified in claim 3 wherein said means for detachably attaching each said light fixture assembly to said light-fixture attachment T-section comprises:

a) said light fixture further comprising a first mounting flange and a second mounting flange, where the first mounting flange is attached to one side of the lower side of the lamp housing and the second mounting flange is attached to the opposite side of the lower side of the lamp housing, with each said mounting flange having a mounting bore therethrough having attached to its inside surface, in alignment with the mounting bore, a captive threaded nut, b) a U-shaped housing mounting bracket having a first upward section, a second upward section and a contiguous center section, with each upward section having near its edge a vertical adjustment bore, and with the center section having substantially centered a horizontal adjustment bore, where when the two vertical adjustment bores interface with the respective mounting bores on said first and second mounting flange, and a wing bolt is inserted into the two bores and threaded nut, the lamp housing can be adjusted vertically and tightened by the wing bolt, c) a horizontal mounting structure having a back edge and a front segment consisting of a downward extending channel having a front channel section and a back channel section, with said front channel section having side-by-side first and second front swivel bores and said back channel section having side-by-side first and second back swivel bores, structure having near its back edge an attachment bore that when aligned with the horizontal adjustment bore on said U-shaped housing mounting bracket and a bolt is inserted into a nut, said lamp housing can be rotated and locked in selectable horizontal positions, d) a first light-fixture leg having a vertical section with an upper end and a lower end, from where the lower end contiguously extends inwardly a horizontal section, with the vertical section further having near its upper end a swivel bore, where when said first light fixture leg is inserted into the channel of said horizontal mounting structure and the first swivel bore interfaces with the respective first front and back swivel bores on said horizontal structure, and a first swivel pin is inserted through the three bores, the first light fixture leg is free to pivot about the first swivel pin, e) a second light-fixture leg having a vertical section with an upper end and a lower end, from where the lower end contiguously extends inwardly a horizontal section, with the vertical section further having near its upper end a swivel bore, where when said second light fixture leg is inserted into the channel of said horizontal mounting structure and the second swivel bore interfaces with the respective front and back swivel bores on said horizontal structure, and a second swivel pin is inserted through the three bores, the second light fixture leg is free to pivot about the second swivel pin, where when said first and second light fixture legs are pressed together they are sized to be frictionally inserted into either the first or second end of said light-fixture attachment T-section, and securely attached within the T-section by an attachment means, and f) means for maintaining said first and second light fixture legs in an open, extended position to allow said light fixture assembly when removed from said light-fixture attachment T-section, to be placed upon a surface remote from said portable twin-mounted light assembly.

14. The assembly as specified in claim 13 wherein said means for securely attaching said legs within said light-fixture attachment T-section comprises:

a) a light-fixture attachment T-section having an upper wall through which and near its first end, is located a first tightening bore and near its second end is located a second tightening bore, b) a captive threaded nut aligned and attached over each of the tightening bores, and c) a leg tightening wing bolt threaded through each of the nuts and through the tightening bores, where each bolt includes a lower end that has attached a clamping structure having an outer contoured surface that corresponds to the curved surface of the horizontal section of each said leg, where when the wing bolt is tightened, the clamping structure presses against said legs to thus secure said legs to said light-fixture attachment T-section.

15. The assembly as specified in claim 14 wherein said means for maintaining said legs in an open, extended position comprises:

a) said first and second light-fixture legs being of tubular construction, and b) a leaf spring having a first end, a second end, and dimensioned to be placed over or under the first and second swivel pins with the first end inserted into the first light-fixture leg and the second end inserted into the second light-fixture leg, where when inserted, the force of said leaf spring forces the first and second light fixture legs to extend outwardly until stopped when the upper end of the legs abut with the horizontal mounting structure to allow the two legs to be maintained in an optimum, extended position.

16. The assembly as specified in claim 13 wherein said means for maintaining said legs in an extended position comprises:

a) a first light-fixture leg having a first leg bore through its vertical section, b) a second light-fixture leg having a second leg bore through its vertical section, c) a horizontal split latch comprising:

(1) a first section having on its outward end a first swivel bore that when aligned with the first leg bore and a first swivel pin is inserted therethrough, said first light-fixture leg is free to swivel, and on its inward end a first side of the split latch, and (2) a second section having on its outward end a second swivel bore that when aligned with the second leg bore and a second swivel pin is inserted therethrough, said second light-fixture leg is free to swivel, and on its inward end a second side of the split latch, where when the first and second sections are in a horizontal position with the split latch in its locked configuration, the two legs are maintained in their extended positions.

17. The apparatus as specified in claim 3 wherein said lamp is a halogen lamp.

18. The apparatus as specified in claim 17 wherein the lamp housing of said light assembly further comprises a protective lamp cage that is attached to the front side of the lamp housing by an attachment means.

19. The apparatus as specified in claim 18 wherein the lamp housing of said light assembly further comprises a handle that is attached to the upper side of the lamp housing by an attachment means.

20. The apparatus as specified in claim 19 wherein the switch/circuit breaker further comprises a water-proof jacket that encompasses a switch lever that projects through a front of the lamp-power junction box.

* * * * *